US010987957B2

(12) United States Patent
Kudo et al.

(10) Patent No.: US 10,987,957 B2
(45) Date of Patent: Apr. 27, 2021

(54) LIQUID CONTAINER AND LIQUID EJECTING APPARATUS

(71) Applicant: SEIKO EPSON CORPORATION, Tokyo (JP)

(72) Inventors: Shoma Kudo, Shiojiri (JP); Naomi Kimura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/789,124

(22) Filed: Feb. 12, 2020

(65) Prior Publication Data

US 2020/0254794 A1 Aug. 13, 2020

(30) Foreign Application Priority Data

Feb. 13, 2019 (JP) ..... JP2019-023378

(51) Int. Cl.
*B41J 25/00* (2006.01)
*B41J 2/175* (2006.01)

(52) U.S. Cl.
CPC ..... *B41J 25/006* (2013.01); *B41J 2/17563* (2013.01)

(58) Field of Classification Search
CPC ... B41J 25/006; B41J 2/17563; B41J 2/17503
See application file for complete search history.

(56) References Cited

U.S. PATENT DOCUMENTS

2003/0227520 A1* 12/2003 Yamanaka ..... B41J 2/17509 347/85
2015/0352853 A1* 12/2015 Kudo ..... B41J 2/175 347/86
2017/0197427 A1* 7/2017 Yamada ..... B41J 2/14024

FOREIGN PATENT DOCUMENTS

JP 2015-182280 A 10/2015

* cited by examiner

*Primary Examiner* — Jason S Uhlenhake
(74) *Attorney, Agent, or Firm* — Oliff PLC

(57) ABSTRACT

A liquid container includes a first liquid accommodating chamber 31, a filter 50, a filter chamber 42 in which the filter is disposed, and a partition wall 47 that divides the first liquid accommodating chamber and the filter chamber. The filter chamber is disposed on the −Z side of the first liquid accommodating chamber, which is vertically below the first liquid accommodating chamber. The partition wall has a flow-out path 51, which has an outlet 106 covered by the filter and through which the liquid having passed through the filter flows to the liquid ejecting head, a first communication path 48 having a first communication port 111, and a second communication path 49 having a second communication port 112. The communication paths are provided at positions different from the position of the flow-out path and communicate with the first liquid accommodating chamber and the filter chamber.

7 Claims, 9 Drawing Sheets

LIQUID CONTAINER AND LIQUID EJECTING APPARATUS

The present application is based on, and claims priority from JP Application Serial Number 2019-023378, filed Feb. 13, 2019, the disclosure of which is hereby incorporated by reference herein in its entirety.

BACKGROUND

1. Technical Field

The present disclosure relates to a liquid container and a liquid ejecting apparatus on which the liquid container is loaded.

2. Related Art

In a known on-carriage liquid ejecting apparatus, a liquid container accommodating liquid to be supplied to a liquid ejecting head that ejects liquid is loaded on a carriage that carries the liquid ejecting head. The liquid container has a liquid accommodating chamber that accommodates the liquid, and a liquid flow path through which the liquid to be supplied from the liquid accommodating chamber to the liquid ejecting head flows. A filter for filtering the liquid to be supplied to the liquid ejecting head is provided in the liquid flow path. In the liquid container, the liquid in the liquid accommodating chamber is supplied to the liquid ejecting head after being filtered with the filter.

In the liquid container, air in the liquid accommodating chamber may enter the liquid flow path and is attached to the filter in the form of bubbles. The bubbles inhibit smooth supply of the liquid to the liquid ejecting head. In JP-A-2015-182280, a buffer chamber is provided upstream of the filter, and a ceiling wall of the buffer chamber is inclined to guide the bubbles to a position where they do not inhibit the supply of the liquid. This buffer chamber serves as a filter chamber, into which the liquid to pass through the filter flows.

However, in the configuration in JP-A-2015-182280, the treatment of the bubbles in the filter chamber when the liquid ejecting apparatus is used in a state in which the liquid container is inclined is not fully considered.

SUMMARY

According to an aspect of the present disclosure, a liquid container loaded, in a use orientation, on a carriage of a liquid ejecting apparatus including a liquid ejecting head that ejects liquid and the carriage that reciprocates the liquid ejecting head in a first scanning direction and a second scanning direction opposite to the first scanning direction supplies the liquid to the liquid ejecting head and includes: a liquid accommodating chamber configured to accommodate the liquid; a filter for filtering the liquid; a filter chamber in which the filter is disposed; and a partition wall that divides the liquid accommodating chamber and the filter chamber. In the use orientation, the filter chamber is disposed below the liquid accommodating chamber in the vertical direction. The partition wall has a flow-out path that has an outlet covered by the filter and through which the liquid having passed through the filter flows to the liquid ejecting head, and communication paths that are provided at positions different from the position of the flow-out path and that communicate with the liquid accommodating chamber and the filter chamber via a first communication port and a second communication port that are open in the filter chamber.

According to an aspect of the present disclosure, a liquid ejecting apparatus includes a liquid ejecting head that ejects liquid; a carriage that reciprocates the liquid ejecting head in a first scanning direction and a second scanning direction opposite to the first scanning direction; and a liquid container loaded on the carriage and supplying the liquid to the liquid ejecting head. The liquid container is mounted, in a use orientation, on the carriage of the liquid ejecting apparatus including the liquid ejecting head that ejects liquid and the carriage that reciprocates the liquid ejecting head in a first scanning direction and a second scanning direction opposite to the first scanning direction, the liquid container supplying liquid to the liquid ejecting head. The liquid container includes: a liquid accommodating chamber configured to accommodate the liquid; a filter for filtering the liquid; a filter chamber in which the filter is disposed; and a partition wall that divides the liquid accommodating chamber and the filter chamber. In the use orientation, the filter chamber is disposed below the liquid accommodating chamber in the vertical direction. The partition wall has a flow-out path that has an outlet covered by the filter and through which the liquid having passed through the filter flows to the liquid ejecting head, and communication paths that are provided at positions different from the position of the flow-out path and that communicate with the liquid accommodating chamber and the filter chamber via a first communication port and a second communication port that are open in the filter chamber.

DESCRIPTION OF EXEMPLARY EMBODIMENTS

Figure 1:
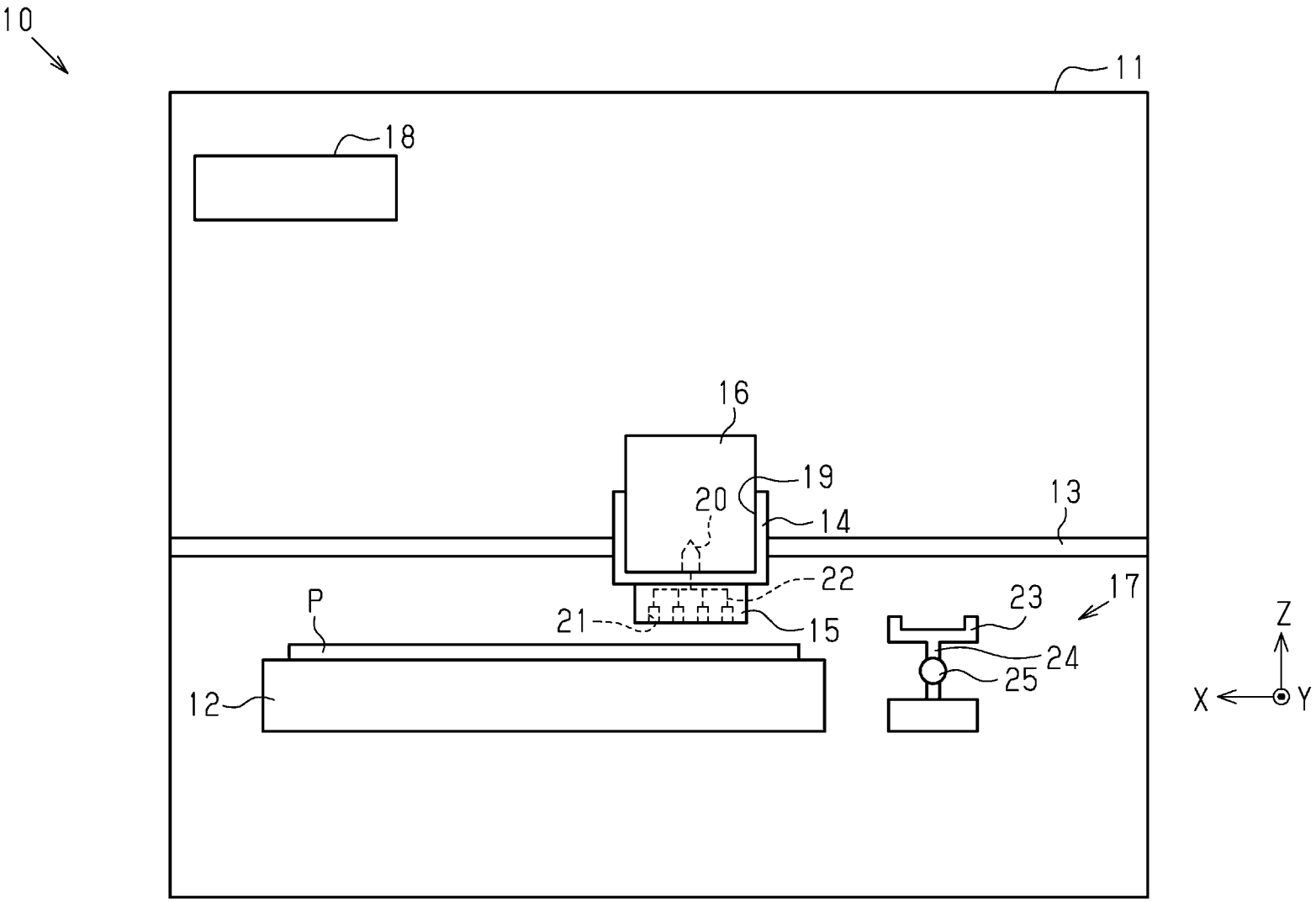
FIG. 1 shows a schematic configuration of an embodiment of a liquid ejecting apparatus.

Referring to the drawings, an embodiment of a liquid container and a liquid ejecting apparatus will be described.

A liquid container is attached to a liquid ejecting apparatus, such as an ink jet printer that ejects ink, serving as an example of liquid, onto a medium, such as a sheet, to print text, images, etc., on the medium.

FIG. 1 shows a schematic configuration of an embodiment of a liquid ejecting apparatus. The X, Y, and Z axes in FIG. 1 are three spatial axes that are perpendicular to one another. The directions pointed by arrows corresponding to the X, Y, and Z axes are positive directions parallel to the X, Y, and Z axes. The positive directions parallel to the X, Y, and Z axes are described as +X, +Y, and +Z directions, respectively. The directions opposite to the directions pointed by the arrows corresponding to the X, Y, and Z axes are negative directions parallel to the X, Y, and Z axes. The negative directions parallel to the X, Y, and Z axes are described as −X, −Y, and −Z directions, respectively. The directions parallel to the X, Y, and Z axes, regardless of positive or negative, are described as the X, Y, and Z directions, respectively. In a liquid ejecting apparatus 10, in a use state in which the liquid ejecting apparatus 10 is disposed on a horizontal surface extending in the X and Y directions, the +Z direction corresponds to the upward direction in the vertical direction, and the −Z direction corresponds to the downward direction in the vertical direction. In the description below, the X, Y, and Z directions are based on the liquid ejecting apparatus 10 in a use state. The X, Y, and Z axes in other figures correspond to the X, Y, and Z axes in FIG. 1.

As shown in FIG. 1, the liquid ejecting apparatus 10 includes a case 11, a support base 12, a guide shaft 13, a carriage 14, a liquid ejecting head 15, a liquid container 16, a maintenance unit 17, and a controller 18.

The support base 12 extends in the X direction within the case 11 and supports a medium P from below. The medium P is transported over the support base 12 in a sub-scanning direction, which is perpendicular to a main scanning direction, in which the carriage 14 moves, by a feeding mechanism (not shown). In the liquid ejecting apparatus 10, the main scanning direction is the X direction, and the sub-scanning direction is the Y direction.

The guide shaft 13 is on the +Z side of the support base 12. The guide shaft 13 is a rod-shaped member extending in the X direction, which is the main scanning direction. The guide shaft 13 supports the carriage 14 so as to be movable along the guide shaft 13. The carriage 14 can be moved in a reciprocating manner along the guide shaft 13 by a moving mechanism (not shown). In other words, the carriage 14 can be moved in the +X direction, which is a first scanning direction, and in the −X direction, which is a second scanning direction.

The carriage 14 has an attachment portion 19 to which the liquid container 16 is removably attached. The attachment portion 19 is, for example, a recess that is open on the +Z side. The attachment portion 19 forms an attachment space into which the liquid container 16 is attached. The attachment portion 19 has a supply needle 20 projecting toward the +Z side from the bottom surface of the attachment space. The supply needle 20 is connected to the liquid container 16 attached to the attachment portion 19.

The liquid ejecting head 15 is loaded on the carriage 14. The liquid ejecting head 15 is located on the −Z side of the attachment portion 19. The liquid ejecting head 15 has a plurality of nozzles 21 through which liquid is ejected onto a medium P supported by the support base 12 to perform printing, and communication flow paths 22 that communicate between the nozzles 21 and the supply needle 20. When the liquid container 16 is attached to the attachment portion 19, the liquid in the liquid container 16 is supplied to the nozzles 21 through the supply needle 20 and the communication flow paths 22.

The maintenance unit 17 performs maintenance of the liquid ejecting head 15. The maintenance unit 17 is located on the −Z side of a stand-by position of the carriage 14. The maintenance unit 17 includes a cap 23 that can be moved vertically toward and away from the liquid ejecting head 15, a discharging path 24 connected at the upstream end thereof to the cap 23, and a discharging pump 25 provided in the middle of the discharging path 24.

The maintenance unit 17 performs a cleaning operation, in which, in a state in which the cap 23 is in contact with the liquid ejecting head 15, the space enclosed between the cap 23 and the liquid ejecting head 15 is vacuumed with a discharging pump 25 to remove the liquid from the nozzles 21.

In the maintenance unit 17, the cap 23 not in contact with the liquid ejecting head 15 receives the liquid ejected from the liquid ejecting head 15 in a flushing operation, in which liquid is ejected from the nozzles 21 regardless of printing.

The controller 18 includes a processing circuit or the like including, for example, a computer and a memory and controls various operations of the liquid ejecting apparatus 10 according to programs stored in the memory. The controller 18 controls, for example, feeding of a medium P, movement of the carriage 14, liquid ejection by the liquid ejecting head 15, and maintenance by the maintenance unit 17.

As described, the liquid ejecting apparatus 10 is an on-carriage liquid ejecting apparatus, in which the liquid ejecting head 15 and the liquid container 16 move in a reciprocating manner with the carriage 14. The attachment portion 19 may be configured to receive a plurality of liquid containers 16. In that case, the liquid containers 16 may contain different types of liquid. The different types of liquid include, for example, ink of different colors, such as black, cyan, magenta, and yellow. The supply needle 20, the nozzles 21, and the communication flow paths 22 are provided for each liquid container 16 that can be attached.

Figure 2:
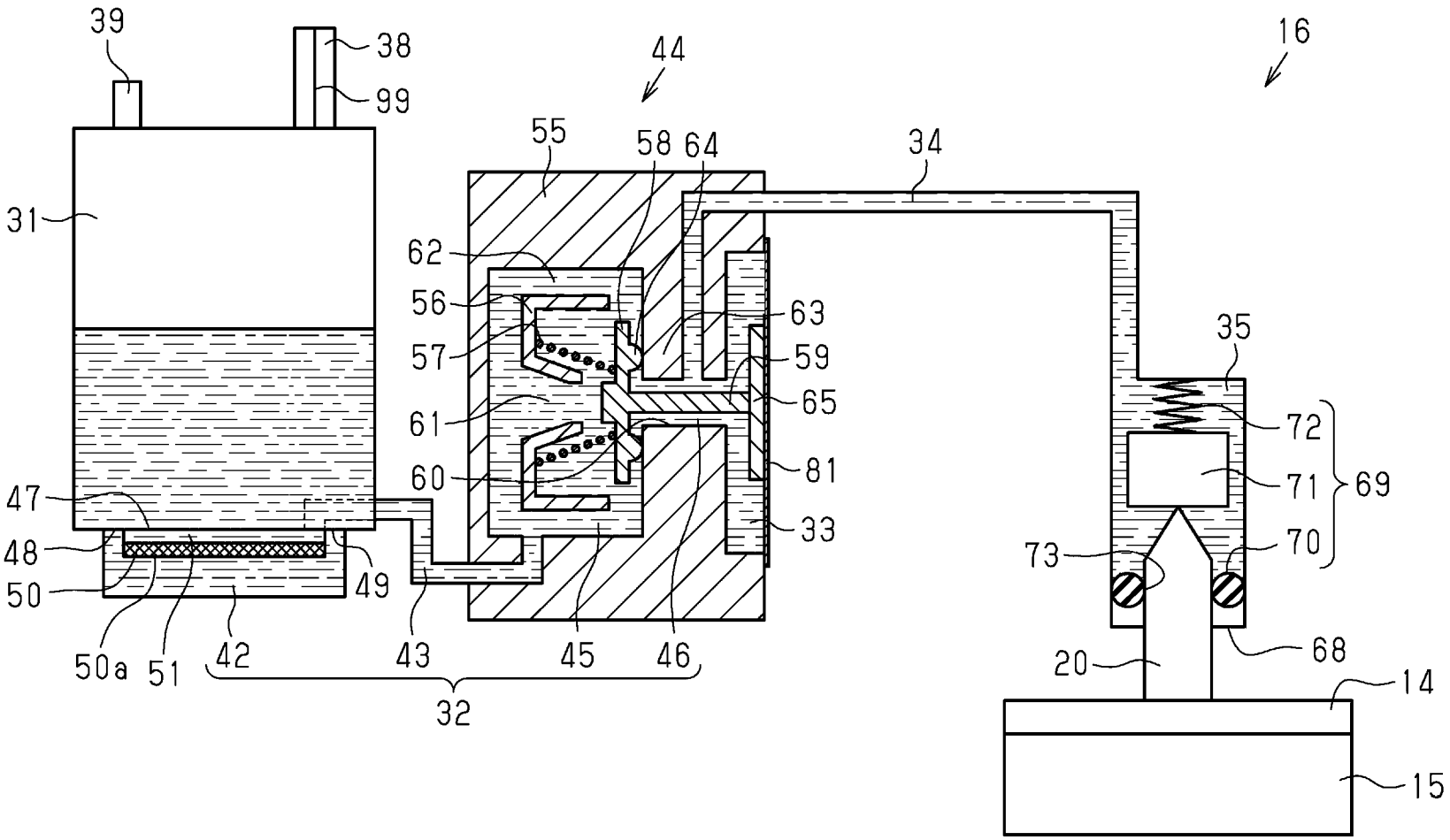
FIG. 2 shows a schematic configuration of the embodiment of a liquid container.

Referring to FIG. 2, a schematic configuration of the liquid container 16 will be described.

In the description below, the expressions "upstream" and "downstream" are used on the basis of the flow of the liquid directed from the liquid container 16 to the liquid ejecting head 15. In FIG. 2, dotted areas show the areas where the liquid exists. The orientation of the liquid container 16 mounted on the carriage 14 of the liquid ejecting apparatus 10 in a use state is referred to as a use orientation.

As shown in FIG. 2, the liquid container 16 includes, from the upstream side, a first liquid accommodating chamber 31, a connecting flow path 32, a second liquid accommodating chamber 33, a liquid communication flow path 34, and a liquid supply portion 35, which serve as main liquid flow paths.

The liquid container 16 is configured to such that a liquid can be supplied from outside to the first liquid accommodating chamber 31 through a liquid pouring portion 38. The first liquid accommodating chamber 31 communicates with the air through an air introducing portion 39.

The first liquid accommodating chamber 31 communicates with the second liquid accommodating chamber 33 through the connecting flow path 32. The first liquid accommodating chamber 31 accommodates the liquid to be supplied to the second liquid accommodating chamber 33, which is, in other words, the liquid before being accommodated in the second liquid accommodating chamber 33.

The connecting flow path 32 connects the first liquid accommodating chamber 31 and the second liquid accommodating chamber 33. The connecting flow path 32 can supply the liquid in the first liquid accommodating chamber 31 to the second liquid accommodating chamber 33. The connecting flow path 32 includes a filter chamber 42, a first intermediate flow path 43, a valve chest 45 of an intermediate valve 44, and a second intermediate flow path 46, in this order from the upstream side. The filter chamber 42 is located further on the −Z side than the first liquid accommodating chamber 31 in the use orientation.

The filter chamber 42 communicates with the first liquid accommodating chamber 31. More specifically, the filter chamber 42 is connected to the first liquid accommodating chamber 31 through a plurality of communication paths provided in a partition wall 47 dividing the first liquid accommodating chamber 31 and the filter chamber 42. The filter chamber 42 in this embodiment is connected to the first liquid accommodating chamber 31 through a first communication path 48 and a second communication path 49.

A filter 50 is disposed in the filter chamber 42. The filter chamber 42 is a space in which the liquid before being filtered by the filter 50 flows. The filter 50 is made of, for example, a stainless steel plate having multiple fine pores. The filter 50 has a flow-in surface 50*a* from which the liquid flows in. The filter 50 allows the liquid to pass through the fine pores and catches a foreign body that is larger than the fine pores. The filter 50 suppresses a foreign body from flowing downstream of the filter 50 by catching a foreign body contained in the filter 50. Thus, clogging of the liquid ejecting head 15 and a liquid ejection defect due to a foreign body are reduced. Furthermore, because the filter 50 is disposed upstream of the intermediate valve 44, the possibility of a foreign body entering the intermediate valve 44 is reduced. Thus, the possibility of an abnormality occurring in the intermediate valve 44 due to a foreign body can be reduced. The filter 50 may be made of a material other than stainless steel, as long as it can catch a foreign body while allowing liquid to pass therethrough.

The liquid having passed through the filter 50 is led out to the first intermediate flow path 43 through a flow-out path 51 provided in the partition wall 47. The flow-out path 51 guides the liquid having passed through the filter 50 to the first intermediate flow path 43 to guide the liquid from the filter chamber 42 to the liquid ejecting head 15.

The first intermediate flow path 43 connects the flow-out path 51 and the valve chest 45 of the intermediate valve 44. The liquid having passed through the filter 50 flows toward the intermediate valve 44 through the first intermediate flow path 43. The intermediate valve 44 controls the liquid flowing from the first liquid accommodating chamber 31 into the second liquid accommodating chamber 33. The intermediate valve 44 is a normally closed valve. The intermediate valve 44 includes a valve casing 55 constituting the valve chest 45. The intermediate valve 44 includes, inside the valve chest 45, a flow-path forming member 56, a first urging member 57, a first valve body 58, and a valve rod 59, in this order from the upstream side. The intermediate valve 44 also has a first valve hole 60 that is provided in the valve casing 55 and is opened and closed by the first valve body 58. The first valve hole 60 communicates with the second liquid accommodating chamber 33 through the second intermediate flow path 46.

The flow-path forming member 56 has a first flow path 61 located inside the first urging member 57. The flow-path forming member 56 forms, together with the valve casing 55, a second flow path 62 located outside the first urging member 57. The flow-path forming member 56 supports the base end portion of first urging member 57 disposed so as to surround the first flow path 61. The first urging member 57 is a compression coil spring. The first urging member 57 is supported by the flow-path forming member 56 at the base end portion thereof, serving as a fixed end, and urges the first valve body 58.

The first valve body 58 is a disc-shaped member and faces a first valve seat 63 surrounding the first valve hole 60. The first valve body 58 is urged toward the first valve seat 63 by the first urging member 57. The first valve body 58 has a ring-shaped sealing portion 64 projecting toward the first valve seat 63. When the sealing portion 64 of the first valve body 58 is in contact with the first valve seat 63, the valve chest 45 and the second liquid accommodating chamber 33 do not communicate with each other. When the sealing portion 64 of the first valve body 58 is not in contact with the first valve seat 63, the valve chest 45 and the second liquid accommodating chamber 33 communicate with each other. The valve rod 59 is a rod-shaped member inserted through the first valve hole 60. The valve rod 59 is connected to the first valve body 58 at one end thereof and can be brought into contact with a pressure receiving plate 65 at the other end thereof.

The pressure receiving plate 65 is a disc-shaped member. The side of the pressure receiving plate 65 opposite from the side adjacent to the valve rod 59 is supported by a first film 81. The first film 81 is disposed so as to cover the pressure receiving plate 65. The pressure receiving plate 65 is urged against the first film 81 by the first urging member 57 via the first valve body 58 and the valve rod 59.

When the liquid in the second liquid accommodating chamber 33 is supplied to the liquid ejecting head 15, and as a result, the pressure inside the second liquid accommodating chamber 33 has reached a predetermined negative value, the first film 81 presses the pressure receiving plate 65 in a direction in which the sealing portion 64 of the first valve body 58 is separated from the first valve seat 63 by overcoming the urging force of the first urging member 57. As a result, the sealing portion 64 of the first valve body 58 is separated from the first valve seat 63, the intermediate valve 44 is opened, allowing the valve chest 45 and the second liquid accommodating chamber 33 to communicate with each other. In this state, the liquid is supplied from the first liquid accommodating chamber 31 to the second liquid accommodating chamber 33, increasing the pressure inside the second liquid accommodating chamber 33. Once the pressure in the second liquid accommodating chamber 33 has increased to a predetermined value, the first urging member 57 urges the sealing portion 64 of the first valve body 58 toward the first valve seat 63. When the sealing portion 64 of the first valve body 58 is seated on the first valve seat 63, the intermediate valve 44 is closed, and the valve chest 45 and the second liquid accommodating chamber 33 do not communicate with each other. In short, when the pressure inside the second liquid accommodating chamber 33 has reached a predetermined negative value as a result of the liquid ejecting head 15 consuming the liquid, the intermediate valve 44 is opened to supply the liquid to the second liquid accommodating chamber 33, and, when the pressure inside the second liquid accommodating chamber 33 has increased to a predetermined value, the intermediate valve 44 is closed to shut off the supply of the liquid to the second liquid accommodating chamber 33.

The second liquid accommodating chamber 33 accommodates the liquid to be supplied to the liquid supply portion 35. The second liquid accommodating chamber 33 is connected to the liquid supply portion 35 via the liquid communication flow path 34. The second liquid accommodating chamber 33 can supply the liquid to the liquid supply portion 35 through the liquid communication flow path 34.

The liquid supply portion 35 has an insertion port 68. The insertion port 68 receives the supply needle 20 provided on the attachment portion 19. As a result of the supply needle 20 being inserted into the insertion port 68, the liquid supply portion 35 is connected to the supply needle 20. Thus, the liquid can be supplied from the liquid supply portion 35 to the supply needle 20. The liquid supply portion 35 has a valve mechanism 69 for opening and closing the flow path inside the liquid supply portion 35. The valve mechanism 69 includes a second valve seat 70, a second valve body 71, and a second urging member 72. The second valve seat 70 is a substantially ring-shaped member. The second valve seat 70 is an elastic member made of, for example, rubber or elastomer. The second valve seat 70 is press-fitted to the liquid supply portion 35. The second valve body 71 is a substantially cylindrical member. The second urging member 72 is a compression coil spring. The second urging member 72 urges the second valve body 71 toward the second valve seat 70. Before the liquid container 16 is mounted on the carriage 14, the second valve body 71 is urged by the second urging member 72 and closes the valve hole 73 provided in the second valve seat 70. When the liquid container 16 is mounted on the carriage 14, the second valve body 71 is pressed by the supply needle 20 and moves away from the second valve seat 70. As a result, the valve mechanism 69 is opened, and thus, the liquid can be supplied from the feeding unit 35 to the supply needle 20.

Referring to FIGS. 3 to 12, the liquid container 16 will be described in more detail. Note that, in FIG. 4, the direction toward the near side with respect to the plane of the drawing is the +X direction, and the direction toward the far side with respect to the plane of the drawing is the −X direction.

Figure 3:
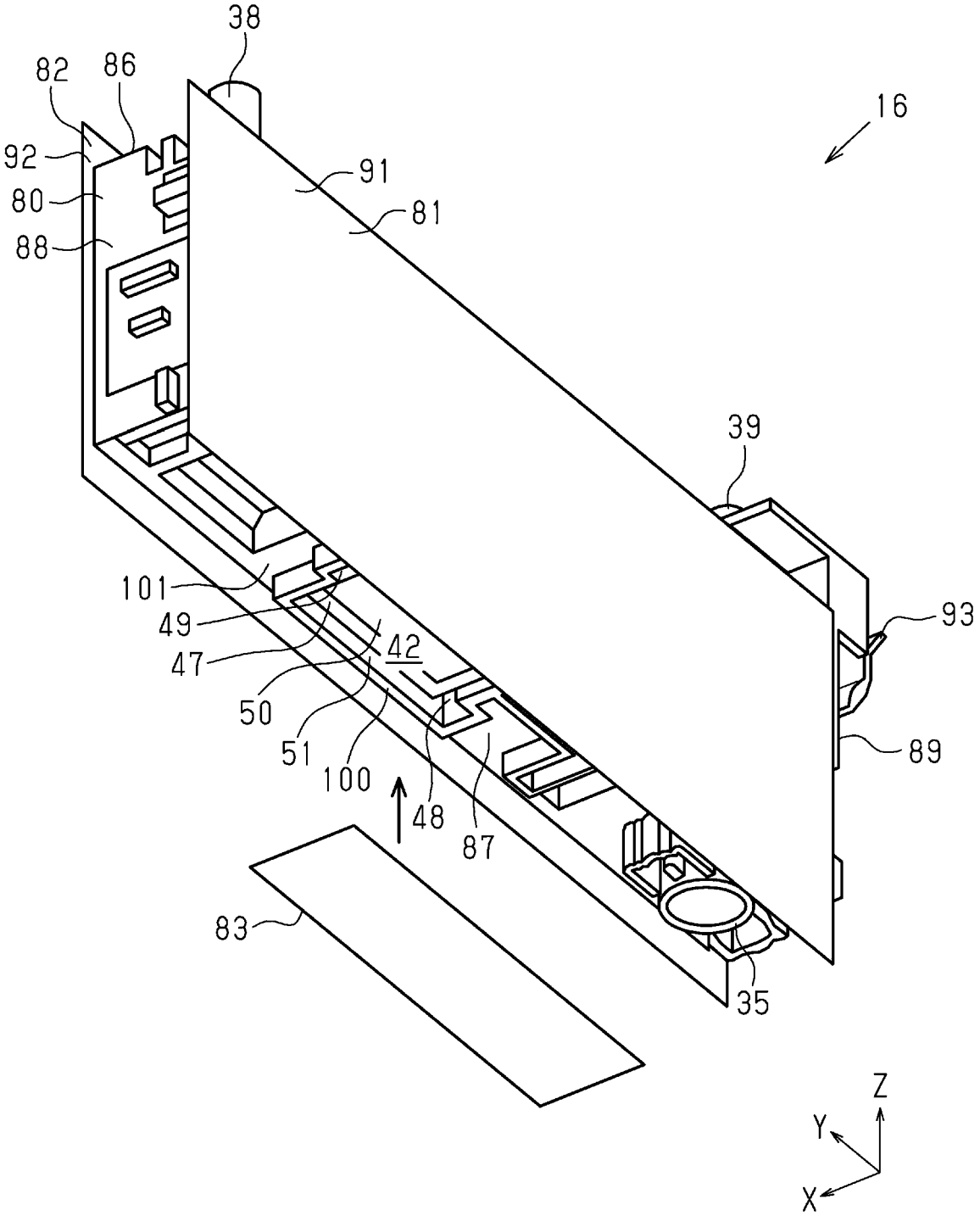
FIG. 3 is a perspective view of the liquid container in a use orientation, as viewed from below in the vertical direction.
Figure 4:
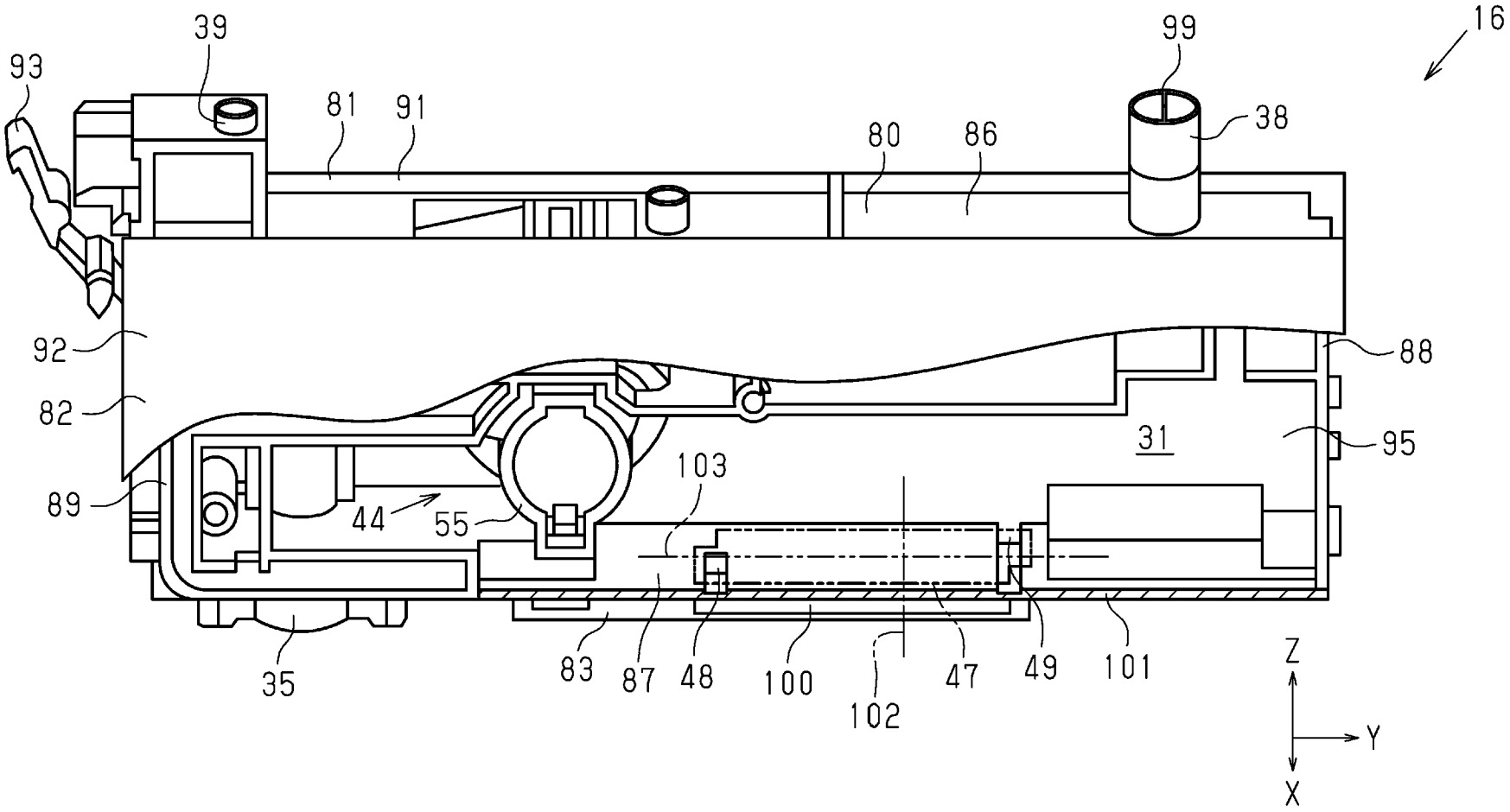
FIG. 4 is a perspective view of the liquid container in the use orientation, as viewed from below in the vertical direction.

As shown in FIGS. 3 and 4, the liquid container 16 includes a container body 80, a first film 81, a second film 82, and a third film 83. The liquid container 16 has a substantially rectangular parallelepiped shape. The longitudinal direction of the liquid container 16 is the Y direction, and the transverse direction of the liquid container 16 is the X direction. The liquid container 16 has an upper wall 86, a bottom wall 87, a front wall 88, a back wall 89, a first side wall 91, and a second side wall 92.

In the liquid container 16 in the use orientation, the upper wall 86 and the bottom wall 87 extend in the X and Y directions. The upper wall 86 is located on the +Z side. The bottom wall 87 is located on the −Z side. The upper wall 86 and the bottom wall 87 are formed by the container body 80.

In the liquid container 16 in the use orientation, the front wall 88 and the back wall 89 extend in the X and Z directions. The front wall 88 is located on the +Y side. The back wall 89 is located on the −Y side. The front wall 88 and the back wall 89 are formed by the container body 80.

In the liquid container 16 in the use orientation, the first side wall 91 and the second side wall 92 extend in the X and Z directions. The first side wall 91 is located on the −X side. The first side wall 91 is formed by the first film 81. The second side wall 92 is located on the +X side. The second side wall 92 is formed by the second film 82.

A lever 93 used when the liquid container 16 is attached to or removed from the attachment portion 19 of the carriage 14 is provided on the back wall 89. The lever 93 can be elastically deformed. The lever 93 is engaged with the attachment portion 19 to prevent the liquid container 16 from coming off from the attachment portion 19. When the lever 93 is disengaged from the attachment portion 19 by a user's operation, the liquid container 16 can be removed from the attachment portion 19.

The container body 80 has a substantially rectangular parallelepiped shape. The container body 80 can be made of a synthetic resin, such as polypropylene or polystyrene. The first film 81, the second film 82, and the third film 83 are all flexible and are attached to different portions of the container body 80 in an airtight manner. Thus, the container body 80, the first film 81, the second film 82, and the third film 83 together form, in the liquid container 16, flow paths for liquid and air.

As shown in FIG. 4, the container body 80 has a recessed shape that is open on the +X side. The container body 80 has a body side wall 95 extending in the Y and Z directions. The body side wall 95 divides the first liquid accommodating chamber 31 and the second liquid accommodating chamber 33.

A recess constituting the first liquid accommodating chamber 31 is formed on the +X side of the body side wall 95. The second film 82 is attached to the +X-side end face of the body side wall 95, that is, the +X-side end face of the container body 80. The second film 82 seals the recess constituting the first liquid accommodating chamber 31. As a result of the second film 82 being attached to the container body 80, the first liquid accommodating chamber 31 is defined.

A recess constituting the second liquid accommodating chamber 33 and a groove constituting the liquid communication flow path 34 are formed on the −X side of the body side wall 95. The first film 81 is attached to the −X-side end face of the body side wall 95, that is, the −X-side end face of the container body 80 in an airtight manner. The first film 81 seals the recess constituting the second liquid accommodating chamber 33 and the groove constituting the liquid communication flow path 34. As a result, the second liquid accommodating chamber 33 and the liquid communication flow path 34 are defined.

The container body 80 has the liquid pouring portion 38. The liquid pouring portion 38 is provided at the +Y-side end of the upper wall 86. The liquid pouring portion 38 extends toward the +Z side. The liquid pouring portion 38 is tubular. The liquid pouring portion 38 communicates with the first liquid accommodating chamber 31 through a flow path (not shown). The liquid pouring portion 38 has a pair of flow paths defined by a partition wall 99. One of the pair of flow paths serves as a liquid pouring path through which the liquid is poured into the first liquid accommodating chamber 31 during liquid pouring, and the other of the pair of flow paths serves as an air discharging path through which air is discharged from the first liquid accommodating chamber 31 during liquid pouring. The liquid pouring portion 38 is sealed by a cap (not shown) when liquid pouring is not performed.

The container body 80 has the air introducing portion 39. The air introducing portion 39 has, at a −Y-side end of the upper wall 86, an air release portion. The air release portion extends toward the +Z side. The air introducing portion 39 communicates with the first liquid accommodating chamber 31 through a flow path and a buffer chamber (not shown). The air introducing portion 39 introduces air into the first liquid accommodating chamber 31 by an amount corresponding to the amount of liquid supplied from the first liquid accommodating chamber 31 to the second liquid accommodating chamber 33 as the liquid ejecting head 15 ejects the liquid.

As shown in FIGS. 3 and 4, a portion of the bottom wall 87 of the container body 80 serves as a partition wall 47 dividing the first liquid accommodating chamber 31 and the filter chamber 42. The container body 80 has a peripheral-wall forming portion 100 that forms a peripheral wall of the filter chamber 42. The peripheral-wall forming portion 100 is joined to the outer periphery of the partition wall 47 so as to be continuous therewith. The peripheral-wall forming portion 100 has a tubular shape extending in the −Z direction. The third film 83 is attached to the −Z-side end face of the peripheral-wall forming portion 100 in an airtight manner. As a result, the filter chamber 42 is defined.

As shown in FIG. 4, a portion of the bottom wall 87 of the container body 80 serves as a bottom-surface forming portion 101, which forms the bottom surface of the first liquid accommodating chamber 31. In FIG. 4, the +X-side end face of the bottom-surface forming portion 101 is hatched. The partition wall 47 is a portion of the bottom-surface forming portion 101. The bottom-surface forming portion 101 is a wall extending in the X and Y directions, and the length in the Y direction is larger than that in the X direction. The longitudinal direction of the bottom-surface forming portion is the Y direction, and the transverse direction of the bottom-surface forming portion is the X direction. The partition wall 47 is provided in an area straddling, in the Y direction, a first central virtual line 102, which is a virtual line showing the center of the bottom-surface forming portion 101 in the Y direction. The partition wall 47 is provided in an area straddling, in the X direction, a second central virtual line 103, which is a virtual line showing the center of the bottom-surface forming portion 101 in the X direction.

The partition wall 47 has the first communication path 48 and the second communication path 49, serving as the communication paths through which the first liquid accommodating chamber 31 and the filter chamber 42 communicate with each other. The first communication path 48 is open in the first liquid accommodating chamber 31, at a position on the −Y side of the first central virtual line 102 and on the +X side of the second central virtual line 103. The second communication path 49 is open in the first liquid accommodating chamber 31, at a position on the +Y side of the first central virtual line 102 and on the −X side of the second central virtual line 103.

In other words, the opening of the first communication path 48 is provided in the first liquid accommodating chamber 31, at a position on the −Y side and +X side in the bottom-surface forming portion 101. The opening of the second communication path 49 is provided in the first liquid accommodating chamber 31, at a position on the +Y side and −X side in the bottom-surface forming portion 101. In other words, the openings of the first communication path 48 and the second communication path 49 in the first liquid accommodating chamber 31 are provided at positions on both sides of the center of the bottom-surface forming portion 101 in the Y direction. The openings of the first communication path 48 and the second communication path 49 in the first liquid accommodating chamber 31 are provided at positions on both sides of the center of the bottom-surface forming portion 101 in the X direction.

Figure 5:
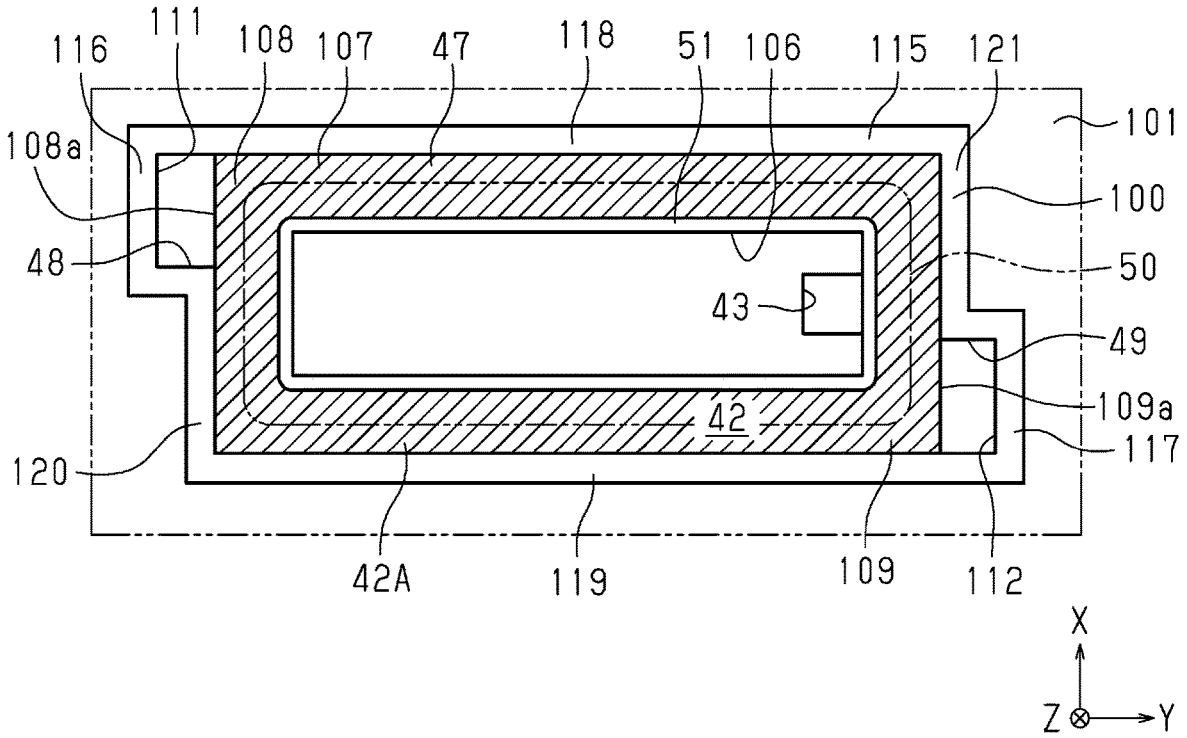
FIG. 5 shows the structure of a filter chamber and the vicinity thereof (with some members omitted) in plan view in which the liquid container in the use orientation is viewed from below in the vertical direction.
Figure 6:
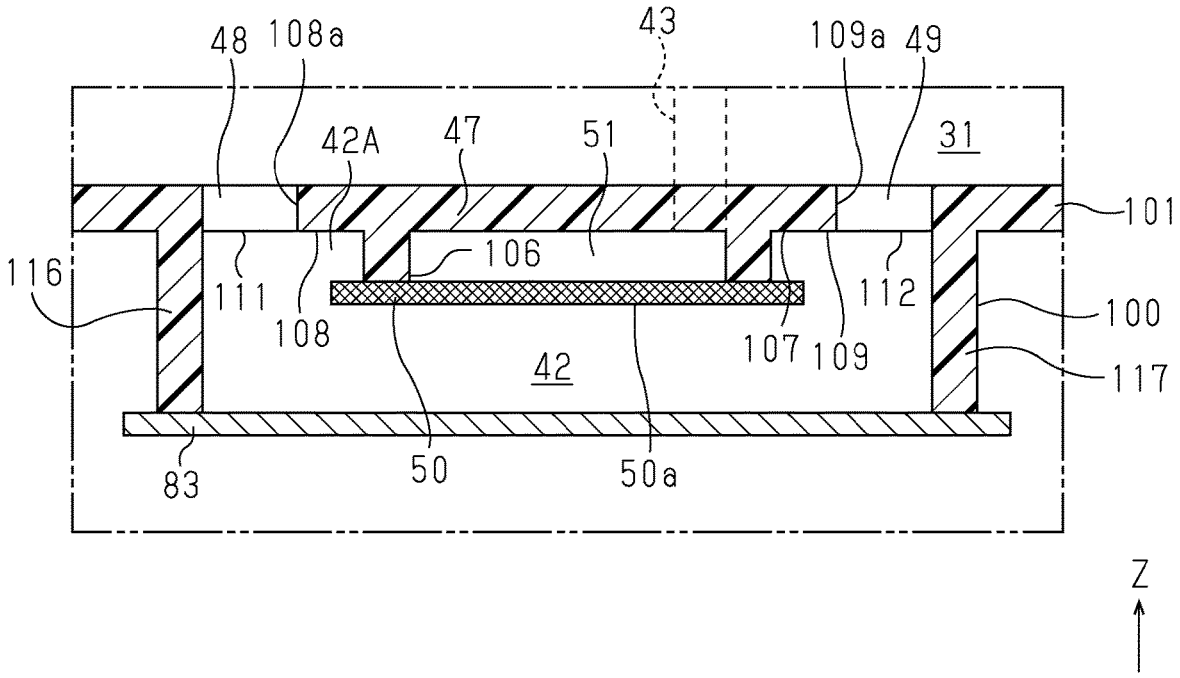
FIG. 6 is a schematic sectional view showing the structure of the filter chamber and the vicinity thereof.

Referring to FIGS. 5 and 6, the structure of the filter chamber 42 and the vicinity thereof will be described in more detail. FIG. 5 is a plan view of the liquid container 16 in the use orientation, as viewed from the −Z direction, showing the structure of the filter chamber 42 and the vicinity thereof, without the third film 83 or the filter 50.

As shown in FIGS. 5 and 6, the partition wall 47 has the flow-out path 51. The flow-out path 51 is located inside the peripheral-wall forming portion 100. The flow-out path 51 has a rectangular or square tube shape extending in the −Z direction. The flow-out path 51 has an outlet 106 at the −Z-side end. The filter 50 is attached to the −Z-side end face of the flow-out path 51. As a result, the outlet 106 is covered by the filter 50. The flow-in surface 50*a* of the filter 50 attached to the flow-out path 51 is located further on the +Z side than the third film 83. The flow-out path 51 guides the liquid having passed through the filter 50 to the first intermediate flow path 43. In other words, the flow-out path 51 guides the liquid having passed through the filter 50 to the liquid ejecting head 15. The filter 50 is formed to have such a size that the outer periphery thereof is located outside the flow-out path 51 in plan view of the liquid container 16 as viewed from the −Z direction and that a gap is formed between itself and the peripheral-wall forming portion 100. The space between the flow-out path 51 and the peripheral-wall forming portion 100 in the direction perpendicular to the Z direction is an opening space 42A, which is a ring-shaped space located further on the +Z side than the filter 50 and in which the first communication path 48 and the second communication path 49 are open.

The partition wall 47 has a filter-chamber forming surface 107 that constitutes the top surface, which is the +Z-side surface, of the filter chamber 42. The filter-chamber forming surface 107 is also a top surface of the opening space 42A. In FIG. 5, the filter-chamber forming surface 107 is hatched. In the liquid container 16 in the use orientation, the filter-chamber forming surface 107 is a surface extending in the X and Y directions. The filter-chamber forming surface 107 has, in plan view of the liquid container 16 as viewed from the −Z direction, a quadrangular, more specifically, a rectangular outer periphery located outside the outlet 106. The longitudinal direction of the filter-chamber forming surface 107 is the Y direction, and the transverse direction of the filter-chamber forming surface 107 is the X direction. The filter-chamber forming surface 107 has a first corner 108 and a second corner 109, which are a pair of corners located diagonal to each other with the outlet 106 therebetween. The first corner 108 includes a portion further on the +X side than the center of the filter-chamber forming surface 107 in the X direction and a portion further on the −Y side than the center of the filter-chamber forming surface 107 in the Y direction. The second corner 109 includes a portion further on the −X side than the center of the filter-chamber forming surface 107 in the X direction and a portion further on the +Y side than the center of the filter-chamber forming surface 107 in the Y direction.

The first communication path 48 has a first communication port 111, which is open in the filter chamber 42. The second communication path 49 has a second communication port 112, which is open in the filter chamber 42. The first communication port 111 and the second communication port 112 are located further on the +Z side than the flow-in surface 50*a* of the filter 50.

In plan view of the liquid container 16 as viewed from the −Z direction, the first communication port 111 has a quadrangular shape extending in the X direction. The first communication port 111 is defined by a portion of the outer edge of the first corner 108. The first communication port 111 is located to the −Y side of the first corner 108, and a portion of a −Y-side outer edge 108*a* of the first corner 108 defines the +Y side of the first communication port 111. The first communication port 111 has a portion located further on the +X side than the outlet 106 in the X direction and has a portion located further on the −Y side than the outlet 106 in the Y direction.

In plan view of the liquid container 16 as viewed from the −Z direction, the second communication port 112 has a quadrangular shape extending in the X direction. The second communication port 112 is defined by a portion of the outer edge of the second corner 109. The second communication port 112 is located to the +Y side of the second corner 109, and a portion of a +Y-side outer edge 109*a* of the second corner 109 defines the −Y side of the second communication port 112. The second communication port 112 has a portion located further on the −X side than the outlet 106 in the X direction and has a portion located further on the +Y side than the outlet 106 in the Y direction.

As shown in FIG. 5, the peripheral-wall forming portion 100 is joined to the outer periphery of the partition wall 47 having the filter-chamber forming surface 107, the first communication port 111, and the second communication port 112 so as to be integral therewith. The peripheral-wall forming portion 100 includes a peripheral wall body 115, a first projection 116, and a second projection 117.

The peripheral wall body 115 includes a wall extending in the −Z direction from portions, in the outer periphery of the partition wall 47, not defining the first communication port 111 or the second communication port 112. The peripheral wall body 115 includes a first wall 118, a second wall 119, a third wall 120, and a fourth wall 121.

In the liquid container 16 in the use orientation, the first wall 118 and the second wall 119 extend in the Y and Z directions. The first wall 118 is located on the +X side, and the second wall 119 is located on the −X side. The third wall 120 and the fourth wall 121 extend in the X and Z directions. The third wall 120 is located on the −Y side, and the fourth wall 121 is located on the +Y side. The −Y-side end of the first wall 118 is joined to the +X-side end of the third wall 120 via the first projection 116. The +Y-side end of the first wall 118 is joined to the +X-side end of the fourth wall 121. The −Y-side end of the second wall 119 is joined to the −X-side end of the third wall 120. The +Y-side end of the second wall 119 is joined to the −X-side end of the fourth wall 121 via the second projection 117. In plan view of the liquid container 16 as viewed from the −Z direction, the peripheral wall body 115 is formed in a rectangular frame shape in which a portion of the wall on the +X side and a portion of the wall on the −X side are open.

The first projection 116 includes a wall extending in the −Z direction from a portion, in the outer periphery of the partition wall 47, defining the first communication port 111. The first projection 116 is joined to the −Y-side end of the first wall 118 and the +X-side end of the third wall 120 so as to be continuous therewith. In plan view of the liquid container 16 as viewed from the −Z direction, the first projection 116 projects in the −Y direction. In other words, in plan view of the liquid container 16 as viewed from the −Z direction, the first projection 116 projects in the −Y direction from the corner of the rectangular-frame-shaped peripheral wall body 115. In plan view of the liquid container 16 as viewed from the −Z direction, the first communication port 111 is formed in the area surrounded by the first projection 116.

The second projection 117 includes a wall extending in the −Z direction from a portion, in the outer periphery of the partition wall 47, defining the second communication port 112. The second projection 117 is joined to the +Y-side end of the second wall 119 and the −X-side end of the fourth wall 121 so as to be continuous therewith. In plan view of the liquid container 16 as viewed from the −Z direction, the second projection 117 projects in the +Y direction. In other words, in plan view of the liquid container 16 as viewed from the −Z direction, the second projection 117 projects in the +Y direction from the corner located diagonal to the corner where the first projection 116 is formed, among the corners of the rectangular-frame-shaped peripheral wall body 115. In plan view of the liquid container 16 as viewed from the −Z direction, the second communication port 112 is formed in the area surrounded by the second projection 117.

The operation of the thus-described liquid container 16 and the liquid ejecting apparatus 10 will be described.

When the intermediate valve 44 is open, the liquid in the first liquid accommodating chamber 31 flows into the filter chamber 42 through the first communication path 48 and the second communication path 49. The liquid having flowed into the filter chamber 42 is guided toward the +Z side and flows into the filter 50. The liquid having passed through the filter 50 is guided into the first intermediate flow path 43 through the flow-out path 51 and is supplied to the intermediate valve 44.

A portion of air entering from the first liquid accommodating chamber 31 to the filter chamber 42 through the first communication path 48 and the second communication path 49 and air dissolved in the liquid are attached, in the form of bubbles, to the flow-in surface 50*a* of the filter 50. Because this reduces the effective area of the filter 50, the flow path resistance increases.

Figure 7:
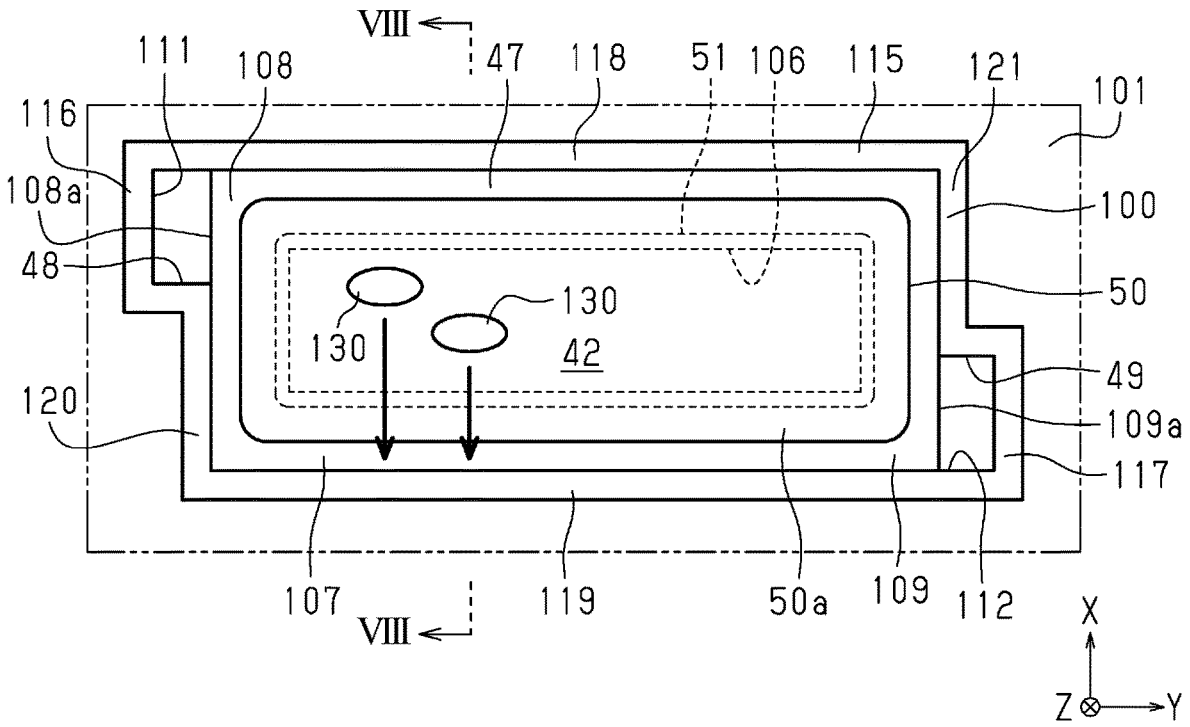
FIG. 7 schematically shows example movement of bubbles in the filter chamber in plan view in which the liquid container in the use orientation is viewed from below in the vertical direction.
Figure 8:
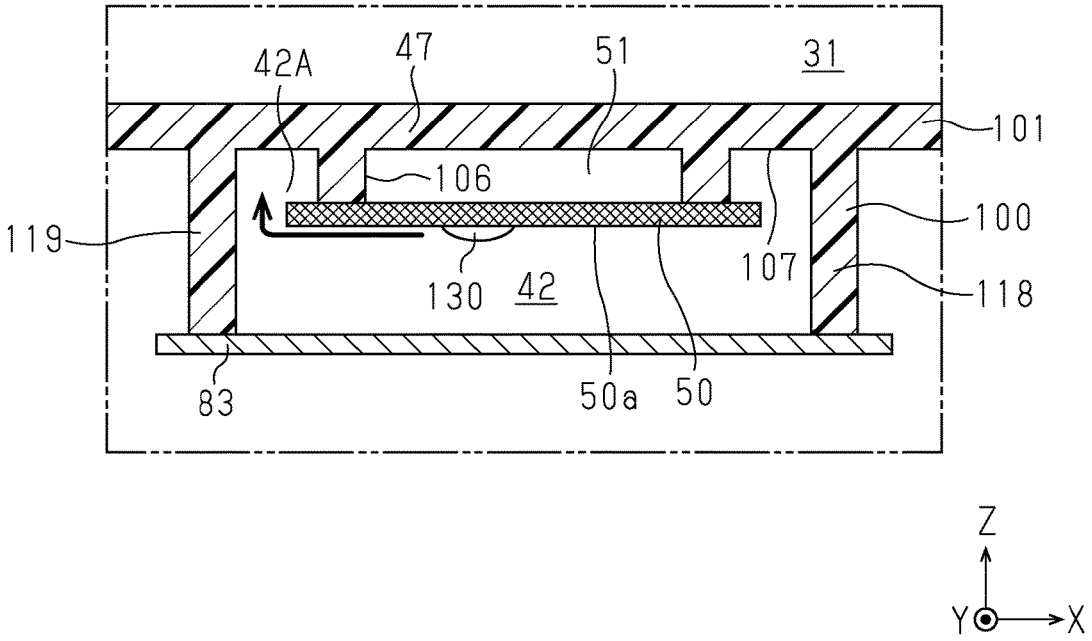
FIG. 8 is a sectional view taken along line VIII-VIII in FIG. 7.

As shown in FIGS. 7 and 8, bubbles 130 attached to the flow-in surface 50*a* of the filter 50 move in the −X direction, as shown by bold arrows, due to the inertia caused by the movement of the carriage 14 in the +X direction and then flow into the opening space 42A due to the buoyancy of the bubbles 130 themselves.

Figure 9:
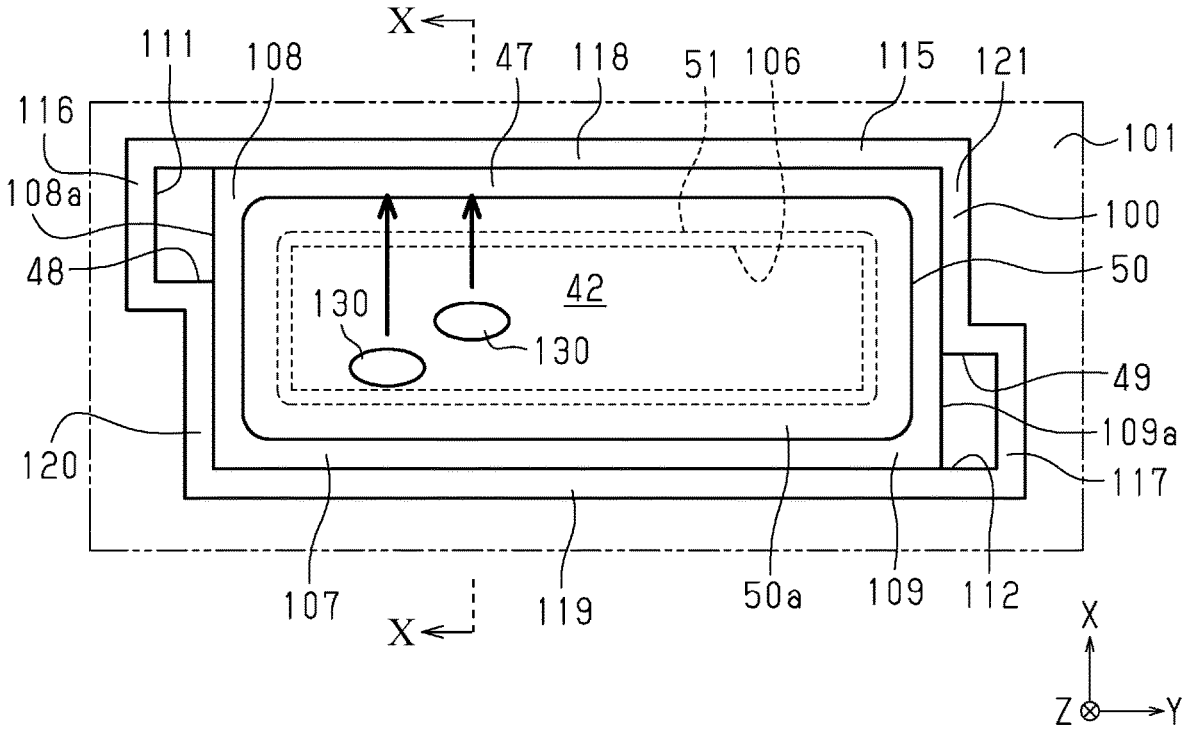
FIG. 9 schematic shows another example movement of bubbles in the filter chamber in plan view in which the liquid container in the use orientation is viewed from below in the vertical direction.
Figure 10:
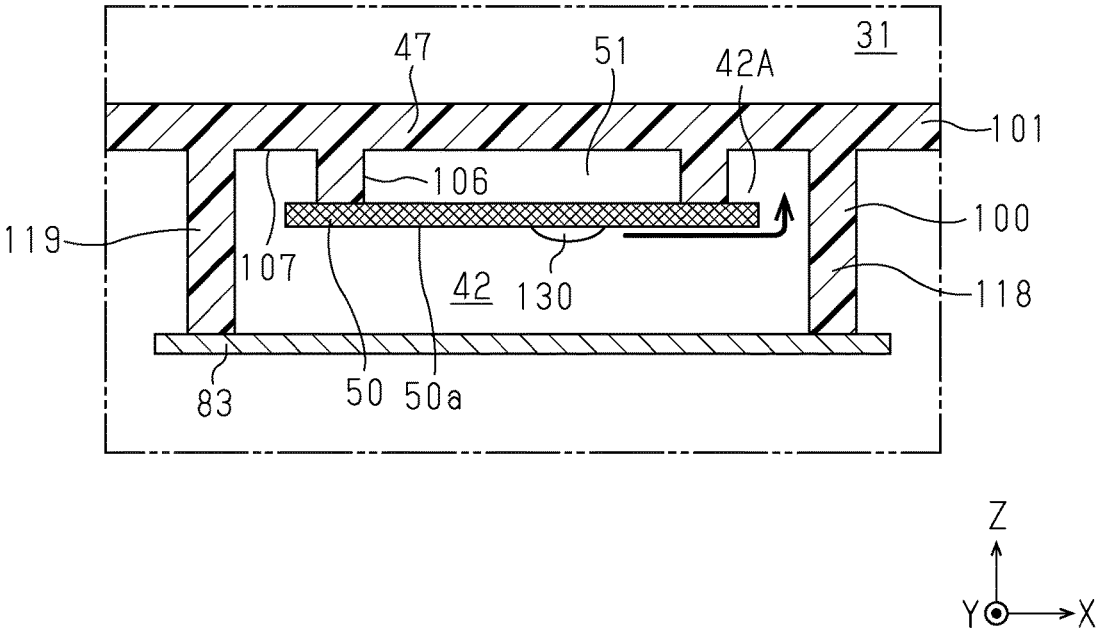
FIG. 10 is a sectional view taken along line X-X in FIG. 9.

As shown in FIGS. 9 and 10, the bubbles 130 attached to the flow-in surface 50*a* of the filter 50 move in the +X direction due to the inertia caused by the movement of the carriage 14 in the −X direction and then flow into the opening space 42A due to the buoyancy of the bubbles 130 themselves.

The bubbles 130 having flowed into the opening space 42A are guided to the filter-chamber forming surface 107 and the peripheral-wall forming portion 100 due to the subsequent movement of the carriage 14 and the like, flow into the first communication port 111 or the second communication port 112, and are discharged into the first liquid accommodating chamber 31.

The advantageous effects of the above-described embodiment will be described.

(1) The liquid container 16 can sometimes be inclined with respect to the Y direction due to improper attachment to the attachment portion 19, vibrations caused by the maintenance performed by the maintenance unit 17 and the movement of the carriage 14, and the like. The liquid container 16 has the first communication path 48 and the second communication path 49 that communicate between the first liquid accommodating chamber 31 and the filter chamber 42. Hence, even if the liquid container 16 is inclined, the bubbles 130 are likely to be guided to the first communication port 111 of the first communication path 48 or the second communication port 112 of the second communication path 49. As a result, compared with a case where there is one opening in the filter chamber 42, the bubbles 130 in the filter chamber 42 can be more effectively discharged to the first liquid accommodating chamber 31, and thus, the bubbles 130 are less likely to be accumulated in the filter chamber 42. As a result, an ejection defect due to the bubbles 130 is less likely to occur.

(2) The first communication port 111 has a portion located further on the +X side than the outlet 106 in the X direction. The second communication port 112 has a portion located further on the −X side than the outlet 106 in the X direction. With this configuration, the bubbles 130 attached to the flow-in surface 50*a* of the filter 50 are likely to be guided to the first communication port 111 or the second communication port 112 by the movement of the carriage 14.

(3) The first communication port 111 has a portion located further on the −Y side than the outlet 106 in the Y direction. The second communication port 112 has a portion located further on the +Y side than the outlet 106 in the Y direction. With this configuration, even if the liquid container 16 is used in an inclined state, the bubbles 130 are likely to be guided to the first communication port 111 or the second communication port 112 by the effect of the inclination of the liquid container 16 or the movement of the carriage 14.

(4) The partition wall 47 has the filter-chamber forming surface 107 having a quadrangular outer periphery. The filter-chamber forming surface 107 has the first corner 108 and the second corner 109, which are a pair of corners located diagonal to each other with the outlet 106 therebetween. The first communication port 111 is defined by a portion of the first corner 108, and the second communication port 112 is defined by a portion of the second corner 109.

With this configuration, one of the first communication port 111 and the second communication port 112 is located on the extreme downstream side in the moving direction of the bubbles 130 when the carriage 14 moves or the liquid container 16 is inclined. As a result, the bubbles 130 are likely to be guided to the first communication port 111 or the second communication port 112 by the movement of the carriage 14 and the inclination of the liquid container 16.

(5) The first communication path 48 is open in the first liquid accommodating chamber 31, at a position on the −Y side of the first central virtual line 102 on the bottom-surface forming portion 101. The second communication path 49 is open in the first liquid accommodating chamber 31, at a position on the +Y side of the first central virtual line 102 on the bottom-surface forming portion 101.

Figure 11:
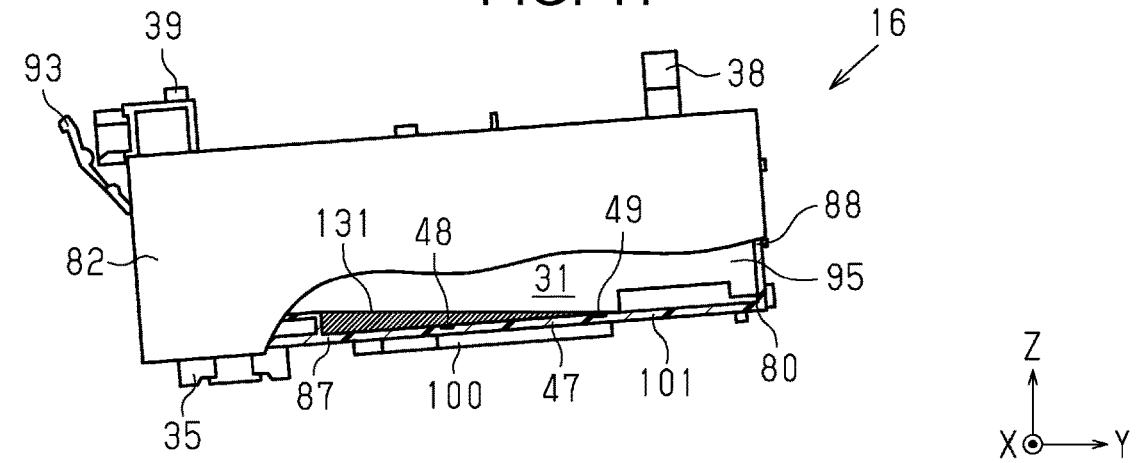
FIG. 11 shows an example state of the first liquid accommodating chamber when the longitudinal direction of the liquid container is inclined.
Figure 12:
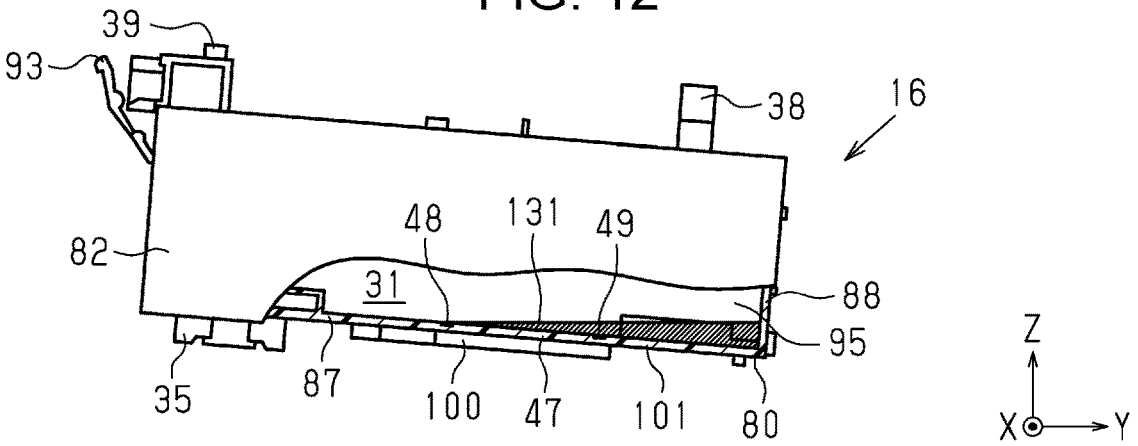
FIG. 12 shows another example state of the first liquid accommodating chamber when the longitudinal direction of the liquid container is inclined.

As shown in FIGS. 11 and 12, with this configuration, even if a liquid surface 131 is inclined with respect to the Y direction when the liquid level in the first liquid accommodating chamber 31 is low, it is easy to maintain a state in which the liquid can be guided to the filter chamber 42 through either one of the first communication path 48 and the second communication path 49. As a result, an ejection defect due to a decrease in the liquid in the first liquid accommodating chamber 31 is less likely to occur.

(6) The first communication path 48 is open in the first liquid accommodating chamber 31, at a position on the +X side of the second central virtual line 103 on the bottom-surface forming portion 101. The second communication path 49 is open in the first liquid accommodating chamber 31, at a position on the −X side of the second central virtual line 103 on the bottom-surface forming portion 101.

With this configuration, even if the liquid surface 131 is inclined with respect to the X direction when the liquid level in the first liquid accommodating chamber 31 is low, it is easy to maintain a state in which the liquid can be guided to the filter chamber 42 through either one of the first communication path 48 and the second communication path 49. As a result, an ejection defect due to a decrease in the liquid in the first liquid accommodating chamber 31 is less likely to occur.

(7) In the case where the liquid is poured into the first liquid accommodating chamber 31 when the liquid level therein is low, because the filter chamber 42 and the liquid surface 131 are close to each other, bubbles are likely to enter the filter chamber 42. In the liquid container 16, the first liquid accommodating chamber 31 and the filter chamber 42 communicate with each other through multiple communication paths, namely, the first communication path 48 and the second communication path 49. Hence, in the filter chamber 42, the flow of the liquid entering from one of the first communication path 48 and the second communication path 49 and exiting from the other of the first communication path 48 and the second communication path 49 is likely to be formed, and thus, the bubbles 130 having entered the filter chamber 42 are likely to be discharged to the first liquid accommodating chamber 31.

In addition, the filter chamber 42 communicates with the first liquid accommodating chamber 31 on both sides of the first central virtual line 102 on the bottom-surface forming portion 101 in the Y direction. The filter chamber 42 communicates with the first liquid accommodating chamber 31 on both sides of the second central virtual line 103 on the bottom-surface forming portion 101 in the X direction. With this configuration, the aforementioned flow of liquid is likely to be formed regardless of the inclination of the liquid container 16, the position of the liquid pouring portion 38, that is, the position from which the liquid flows into the first liquid accommodating chamber 31 during pouring, and the like. Hence, the bubbles 130 having entered the filter chamber 42 during liquid pouring can be efficiently discharged.

(8) In the liquid container 16, the outlet 106, on which the filter 50 is provided, is located below the first communication port 111 and the second communication port 112 in the use orientation. This configuration inhibits the bubbles 130 from being attached to the flow-in surface 50*a* of the filter 50 and inhibits the bubbles 130 once separated from the flow-in surface 50*a* of the filter 50 from being attached again to the flow-in surface 50*a* as a result of flowing into the opening space 42A. This effect is more obvious when the outer periphery of the filter 50 is located outside the flow-out path 51 in plan view of the liquid container 16 as viewed from the −Z direction.

The above-described embodiment may be implemented with the following modifications. The above-described embodiment and the modifications below may be implemented in combination with each other within a technically consistent range.

Figure 13:
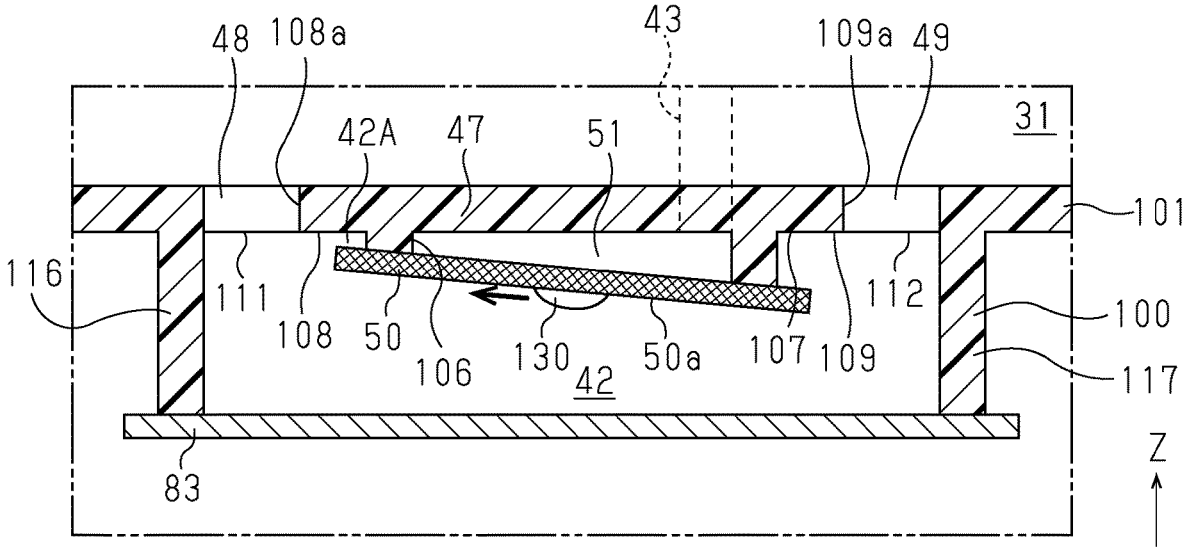
FIG. 13 shows an arrangement of a flow-in surface of the filter according to a modification.

As shown in FIG. 13, in the liquid container 16 in the use orientation, the flow-in surface 50*a* of the filter 50 may be inclined toward the first communication port 111, which is one of a plurality of communication ports. With this configuration, the bubbles 130 are guided to the first communication port 111 along the flow-in surface 50*a* of the filter 50 by means of buoyancy. As a result, the bubbles 130 can be effectively discharged to the first liquid accommodating chamber 31.

Figure 14:
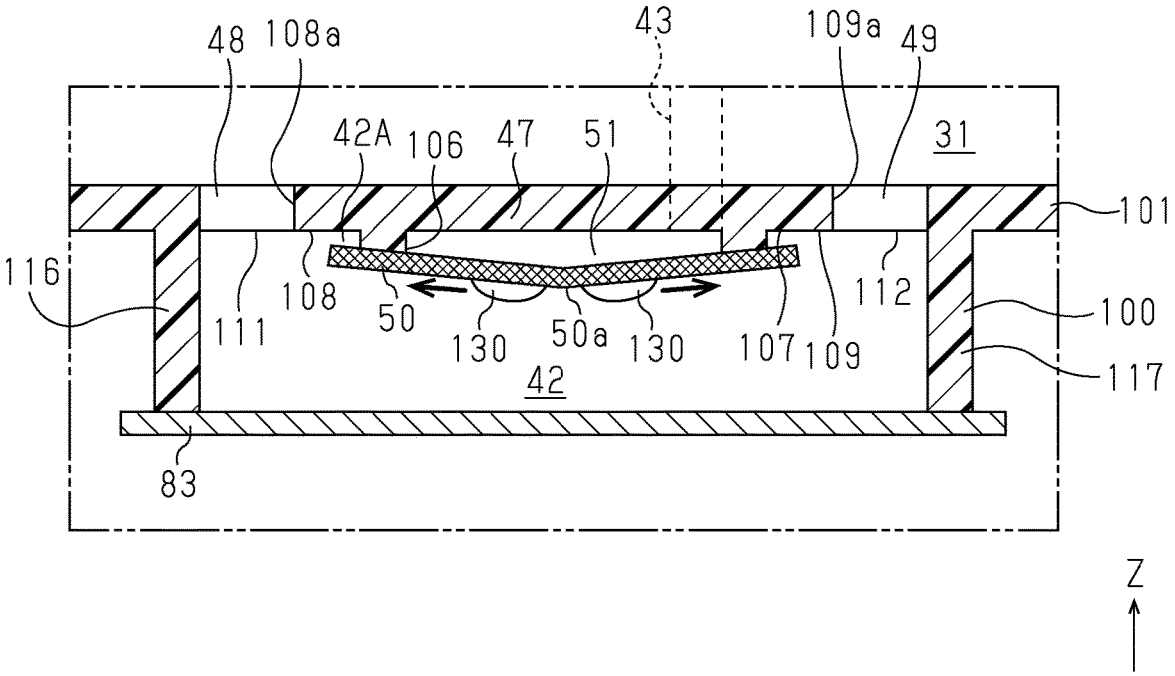
FIG. 14 shows an arrangement of a flow-in surface of the filter according to a modification.

As shown in FIG. 14, in the liquid container 16 in the use orientation, the flow-in surface 50*a* of the filter 50 may be inclined toward the plurality of communication ports. Specifically, for example, the flow-in surface 50*a* of the filter 50 may be bent so as to be inclined toward both the first communication port 111 and the second communication port 112. With this configuration, the bubbles 130 are more efficiently guided to the communication ports along the flow-in surface 50*a* of the filter 50 by means of buoyancy.

The openings, in the first liquid accommodating chamber 31, of the communication paths do not necessarily have to be provided on both sides of the first central virtual line 102 on the bottom-surface forming portion 101. For example, the openings of the communication paths may be provided only on one side of the first central virtual line 102 on the bottom-surface forming portion 101.

The openings, in the first liquid accommodating chamber 31, of the communication paths do not necessarily have to be provided on both sides of the second central virtual line 103 on the bottom-surface forming portion 101. For example, the openings of the communication paths may be provided only on one side of the second central virtual line 103 on the bottom-surface forming portion 101.

The outer periphery of the filter-chamber forming surface 107 of the partition wall 47 does not need to have a rectangular shape. The outer periphery of the filter-chamber forming surface 107 may have another quadrangular shape, such as a lozenge or parallelogram shape.

The filter-chamber forming surface 107 does not need to have a quadrangular outer periphery. The filter-chamber forming surface 107 may have, for example, a polygonal, circular, or oval outer periphery.

The first communication port 111 only needs to be defined by a portion of the outer edge of the first corner 108. For example, the first communication port 111 may have a bent shape defined by the outer edge extending in the −Y direction and the outer edge extending in the +X direction at the first corner 108. The first communication port 111 may be defined only by the outer edge extending in the +X direction at the first corner 108.

The second communication port 112 only needs to be defined by a portion of the outer edge of the second corner 109. For example, the second communication port 112 may have a bent shape defined by the outer edge extending in the +Y direction and the outer edge extending in the −X direction at the second corner 109. The second communication port 112 may be defined only by the outer edge extending in the −X direction at the second corner 109.

Figure 15:
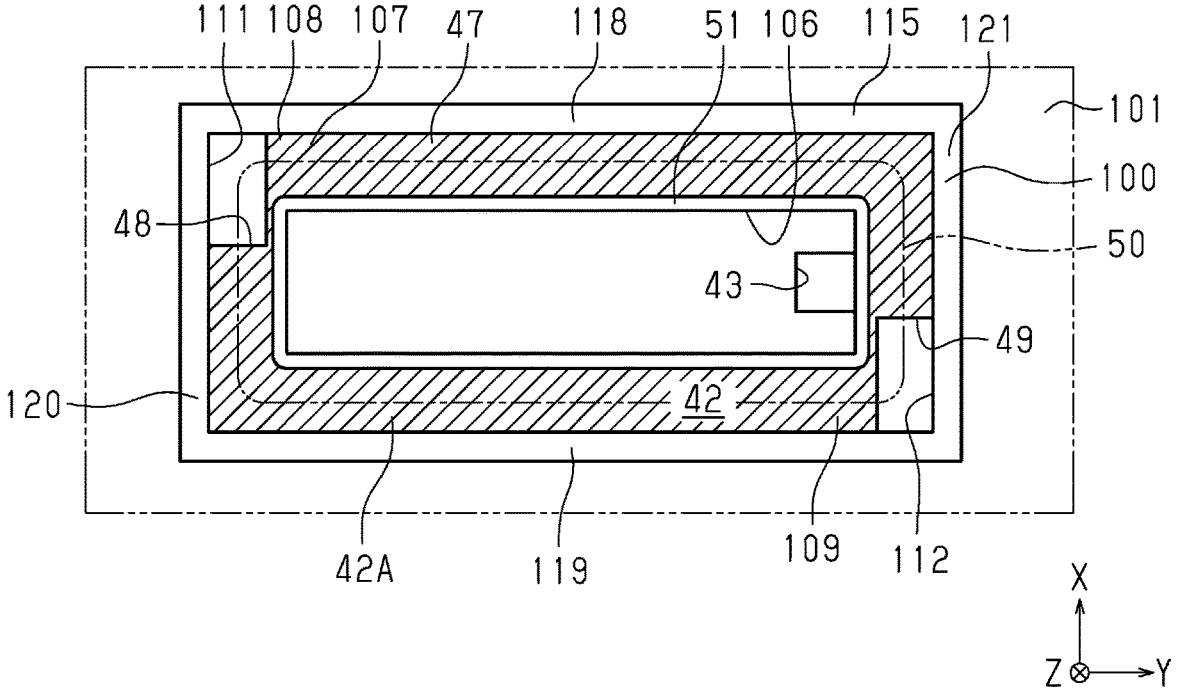
FIG. 15 shows example positions of communication ports in the modification.

As shown in FIG. 15, the peripheral-wall forming portion 100, which forms the peripheral wall of the filter chamber 42, may be formed only of the peripheral wall body 115. In other words, the peripheral-wall forming portion 100 may have a rectangular or square tube shape. In that case, the filter-chamber forming surface 107 of the partition wall 47 has such a shape that a portion of the first corner 108 is cut away by the first communication port 111, and a portion of the second corner 109 is cut away by the second communication port 112. In FIG. 15, the filter-chamber forming surface 107 is hatched.

When the peripheral-wall forming portion 100 formed only of the peripheral wall body 115 has a rectangular or square tube shape, the lateral section thereof may have a lozenge or parallelogram shape. Alternatively, the peripheral-wall forming portion 100 formed only of the peripheral wall body 115 may have a circular or elliptical tube shape.

In plan view of the liquid container 16 as viewed from the −Z direction, the first communication port 111 may have only a portion on the +X side of the outlet 106 in the X direction. In plan view of the liquid container 16 as viewed from the −Z direction, the first communication port 111 may have only a portion on the −Y side of the outlet 106 in the Y direction.

In plan view of the liquid container 16 as viewed from the −Z direction, the second communication port 112 may have only a portion on the −X side of the outlet 106 in the X direction. In plan view of the liquid container 16 as viewed from the −Z direction, the second communication port 112 may have only a portion on the +Y side of the outlet 106 in the Y direction.

The communication paths communicating between the first liquid accommodating chamber 31 and the filter chamber 42 only need to have a plurality of communication ports in the filter chamber 42. Hence, the communication paths may have three or more communication ports in the filter chamber 42.

The communication paths communicating between the first liquid accommodating chamber 31 and the filter chamber 42 only need to have a plurality of communication ports in the filter chamber 42. Hence, for example, the communication paths may be split inside the partition wall 47, so that the number of openings in the first liquid accommodating chamber 31 and that in the filter chamber 42 are different.

The flow-in surface 50*a* of the filter 50 may be disposed at a position flush with the filter-chamber forming surface 107.

The filter 50 may be formed of, for example, a mesh body, a porous body, a perforated plate in which fine through-holes are formed. Examples of the mesh-body filter include a wire mesh, a resin mesh, a mesh filter, and a metal fiber. Examples of the metal-fiber filter include a felt filter in which fine stainless steel wire is felted, and a sintered metal filter in which fine stainless steel wire is compression-sintered. Examples of the perforated-plate filter include an electroforming metal filter, an electron-beam-processed metal filter, a laser-beam-processed metal filter. The mesh filter is formed by weaving wire, and examples thereof include a plain weave filter, a twilled weave filter, a plain Dutch weave filter, and a twilled Dutch weave filter.

The liquid ejecting apparatus 10 may eject or discharge liquid other than ink. The states of the liquid discharged from the liquid ejecting apparatus in the form of fine droplets include a granular state, a teardrop state, and a stringy state. The liquid as used herein may be any material that can be ejected from the liquid ejecting apparatus. For example, the liquid may be a substance in a liquid phase and includes fluids such as a liquid with a high or low viscosity, sol, gel water, other inorganic solvent, organic solvent, solution, liquid resin, liquid metal, and molten metal. The liquid includes not only a liquid as one state of a substance, but also a liquid in which functional-material particles composed of a solid body, such as pigments and metal particles, are dissolved, dispersed, or mixed in a solvent. Typical examples of the liquid are ink, as described in the above-described embodiment, and liquid crystal. Herein, the ink includes various liquid compositions, such as typical water-based ink, oil-based ink, gel ink, and hot melt ink. Examples of the liquid ejecting apparatus include apparatuses used in manufacturing liquid crystal displays, electroluminescence displays, surface emitting displays, color filters, and the like, which eject liquid containing an electrode material, a colorant, or the like dispersed or dissolved therein. Alternatively, the liquid ejecting apparatus may be an apparatus for ejecting a living organic material, which is used in manufacturing biochips; an apparatus used as a precision pipette for ejecting a liquid, serving as a sample; a printing apparatus; or a microdispenser. The liquid ejecting apparatus may be an apparatus for precisely ejecting lubricant onto a precision instrument, such as a timepiece or a camera, or an apparatus for ejecting a transparent resin liquid, such as UV curable resin, onto a substrate to form a micro-hemispherical lens, an optical lens, and the like used in an optical communication element or the like. The liquid ejecting apparatus may be an apparatus for ejecting an acid or alkaline etchant to etch a substrate or the like.

The technical ideas that can be understood from the above-described embodiment and modification will be described.

A liquid container loaded, in a use orientation, on a carriage of a liquid ejecting apparatus including a liquid ejecting head that ejects liquid and the carriage that reciprocates the liquid ejecting head in a first scanning direction and a second scanning direction opposite to the first scanning direction supplies liquid to the liquid ejecting head and includes: a liquid accommodating chamber configured to accommodate the liquid; a filter for filtering the liquid; a filter chamber in which the filter is disposed; and a partition wall that divides the liquid accommodating chamber and the filter chamber. In the use orientation, the filter chamber is disposed below the liquid accommodating chamber in the vertical direction. The partition wall has a flow-out path that has an outlet covered by the filter and through which the liquid having passed through the filter flows to the liquid ejecting head, and communication paths that are provided at positions different from the position of the flow-out path and that communicate with the liquid accommodating chamber and the filter chamber via a first communication port and a second communication port that are open in the filter chamber.

In the liquid ejecting apparatus to which the liquid container is attached, the liquid container may be used in an inclined state. In the above-described configuration, the liquid accommodating chamber and the filter chamber communicate with each other via the communication paths having the plurality of communication ports in the filter chamber. Hence, compared with a configuration in which there is one communication port in the filter chamber, the bubbles having entered the filter chamber are easily discharged to the liquid accommodating chamber by means of buoyancy.

In the above-described liquid container, in plan view in which the liquid container in the use orientation is viewed from below in the vertical direction, the first communication port may have a portion located further in the first scanning direction than the outlet is, and the second communication port may have a portion located further in the second scanning direction than the outlet is.

With this configuration, the bubbles are likely to be guided to the first communication port or the second communication port by the movement of the carriage.

In this liquid container, assuming that a direction perpendicular to the first and second scanning directions is a sub-scanning direction in plan view in which the liquid container in the use orientation is viewed from below in the vertical direction, the first communication port may have a portion located further on one side than the outlet is in the sub-scanning direction, and the second communication port may have a portion located further on the other side than the outlet is in the sub-scanning direction.

With this configuration, even when the liquid container is inclined in the use state of the liquid ejecting apparatus, the bubbles can be guided to the first communication port or the second communication port by the inclination of the liquid container or the movement of the carriage.

In the liquid container, the partition wall may have a filter-chamber forming surface that forms an upper surface, in the vertical direction, of the filter chamber in the use orientation. The filter-chamber forming surface may have an outer periphery located outside the outlet, the outer periphery being formed in a quadrangular shape in plan view in which the liquid container in the use orientation is viewed from below in the vertical direction, and may have a first corner and a second corner, which are a pair of corners located diagonal to each other. The first communication port may have a portion defined by a portion of the outer edge of the first corner, and the second communication port may have a portion defined by a portion of the outer edge of the second corner.

With this configuration, the first communication port or the second communication port is located on the downstream side in the moving direction of the bubbles when the carriage moves or the liquid container is inclined. As a result, the bubbles are likely to be guided to the communication port by the movement of the carriage or the inclination of the liquid container.

In the liquid container, the flow-in surface of the filter may be inclined toward at least one of the first communication port and the second communication port.

With this configuration, the flow-in surface of the filter can guide the bubbles toward the communication port. Hence, it is possible to efficiently discharge the bubbles in the filter chamber.

The liquid container may have a bottom-surface forming portion that includes the partition wall and forms the bottom surface of the liquid accommodating chamber. The communication paths may be open in the liquid accommodating chamber, on one side and the other side of the center of the bottom-surface forming portion in the longitudinal direction of the bottom-surface forming portion.

In the case where the liquid container is inclined in the longitudinal direction of the bottom-surface forming portion when the liquid level in the liquid accommodating chamber is low, compared with the case where the liquid container is inclined in the transverse direction, the openings of the communication paths in the liquid accommodating chamber are likely to be exposed from the liquid surface. In the above-described configuration, the communication paths are open in the liquid accommodating chamber, on one side and the other side of the center of the bottom-surface forming portion in the longitudinal direction. Hence, it is easy to maintain a state in which the liquid can be introduced into the filter chamber through the communication path. Thus, an ejection defect due to a decrease in the liquid in the liquid accommodating chamber is less likely to occur.

A liquid ejecting apparatus includes a liquid ejecting head that ejects liquid, a carriage that reciprocates the liquid ejecting head in a first scanning direction and a second scanning direction opposite to the first scanning direction, and the above-described liquid container that is loaded on the carriage and that supplies the liquid to the liquid ejecting head. With this configuration, the same effect as that provided by the above-described liquid container can be obtained.

What is claimed is:

1. A liquid container loaded, in a use orientation, on a carriage of a liquid ejecting apparatus including a liquid ejecting head that ejects liquid and the carriage that reciprocates the liquid ejecting head in a first scanning direction and a second scanning direction opposite to the first scanning direction, the liquid container supplying the liquid to the liquid ejecting head and comprising:

a liquid accommodating chamber configured to accommodate the liquid;

a filter for filtering the liquid;

a filter chamber in which the filter is disposed; and a partition wall that divides the liquid accommodating chamber and the filter chamber, wherein, in the use orientation, the filter chamber is disposed below the liquid accommodating chamber in a vertical direction, and the partition wall has a flow-out path that has an outlet covered by the filter and through which the liquid having passed through the filter flows to the liquid ejecting head, and communication paths that are provided at positions different from the position of the flow-out path and that communicate with the liquid accommodating chamber and the filter chamber via a first communication port and a second communication port that are open in the filter chamber.

2. The liquid container according to claim 1, wherein, in plan view in which the liquid container in the use orientation is viewed from below in the vertical direction, the first communication port has a portion located further in the first scanning direction than the outlet is, and the second communication port has a portion located further in the second scanning direction than the outlet is.

3. The liquid container according to claim 1, wherein, assuming that a direction perpendicular to the first and second scanning directions is a sub-scanning direction in plan view in which the liquid container in the use orientation is viewed from below in the vertical direction, the first communication port has a portion located further on one side than the outlet is in the sub-scanning direction, and the second communication port has a portion located further on the other side than the outlet is in the sub-scanning direction.

4. The liquid container according to claim 1, wherein the partition wall has a filter-chamber forming surface that forms an upper surface, in the vertical direction, of the filter chamber in the use orientation, the filter-chamber forming surface having an outer periphery located outside the outlet, the outer periphery being formed in a quadrangular shape in plan view in which the liquid container in the use orientation is viewed from below in the vertical direction, and having a first corner and a second corner, which are a pair of corners located diagonal to each other, the first communication port has a portion defined by a portion of an outer edge of the first corner, and the second communication port has a portion defined by a portion of an outer edge of the second corner.

5. The liquid container according to claim 1, wherein a flow-in surface of the filter is inclined toward at least one of the first communication port and the second communication port.

6. The liquid container according to claim 1, further comprising a bottom-surface forming portion that includes the partition wall and forms a bottom surface of the liquid accommodating chamber, wherein the communication paths are open in the liquid accommodating chamber, on one side and the other side of a center of the bottom-surface forming portion in a longitudinal direction of the bottom-surface forming portion.

7. A liquid ejecting apparatus comprising:

a liquid ejecting head that ejects liquid;

a carriage that reciprocates the liquid ejecting head in a first scanning direction and a second scanning direction opposite to the first scanning direction; and the liquid container according to claim 1, the liquid container being loaded on the carriage and supplying the liquid to the liquid ejecting head.

* * * * *